US006606889B1

(12) United States Patent
Tweedy

(10) Patent No.: US 6,606,889 B1
(45) Date of Patent: Aug. 19, 2003

(54) PIVOT LATCH

(75) Inventor: Timothy Tweedy, Elkhart, IN (US)

(73) Assignee: Fastec Industrial Corp., Elkhart, IN (US)

( * ) Notice: Subject to any disclaimer, the term of this patent is extended or adjusted under 35 U.S.C. 154(b) by 0 days.

(21) Appl. No.: 10/156,199

(22) Filed: May 29, 2002

(51) Int. Cl.[7] ..... E05B 13/00

(52) U.S. Cl. ..... 70/208; 70/210; 70/380; 70/469; 70/485; 292/DIG. 31

(58) Field of Search ..... 70/152, 469, 471, 70/483–485, 489, 380, 208, 210, 211; 292/129, 229, DIG. 31

(56) References Cited

U.S. PATENT DOCUMENTS

| | | | | |
|---|---|---|---|---|
| 742,875 A | * | 11/1903 | Keverline | |
| 2,055,688 A | * | 9/1936 | Halinka | |
| 2,648,969 A | * | 8/1953 | Miller et al. | |
| 3,591,224 A | * | 7/1971 | Unter | 292/336.3 |
| 3,789,638 A | * | 2/1974 | Roberts et al. | 70/366 |
| 4,134,281 A | * | 1/1979 | Pelcin | 70/208 |
| 4,413,849 A | * | 11/1983 | Davis et al. | 292/229 |
| 4,546,628 A | * | 10/1985 | Takasaki | 70/92 |
| 5,046,340 A | * | 9/1991 | Weinerman et al. | 70/208 |
| 5,267,762 A | | 12/1993 | Gromotka | 292/229 |
| 5,321,962 A | * | 6/1994 | Ferchau et al. | 70/208 |
| 5,570,915 A | * | 11/1996 | Asadurian | 292/242 |
| 5,609,373 A | | 3/1997 | Gromotka | 292/229 |
| 5,638,709 A | | 6/1997 | Clavin | 70/208 |
| 5,664,813 A | | 9/1997 | Gromotka | 292/229 |
| 6,513,353 B1 | * | 2/2003 | Weinerman et al. | 70/208 |

FOREIGN PATENT DOCUMENTS

| | | | | |
|---|---|---|---|---|
| GB | 2259940 | * | 3/1993 | 292/DIG. 31 |

* cited by examiner

*Primary Examiner*—Lloyd A. Gall
(74) *Attorney, Agent, or Firm*—Dykema Gossett

(57) ABSTRACT

A lever latch, for releasably latching a door to a corresponding door frame, includes a housing having a handle pivotally mounted therein and rotatable between opened and closed positions. In the handle closed position, a bolt mounted to the handle engages the door frame, and in the handle opened position, the bolt is disengaged from the door frame. The housing includes a trigger pivotally mounted therein, and pivotable between a first position to retain the handle in the closed position and a second position to release the handle to the opened position. A pawl is rotatably mounted to a lock cylinder on the housing and rotatable between locked and unlocked positions to allow the trigger to pivot to the second position and to prevent the trigger from being pivoted to the second position, respectively.

22 Claims, 3 Drawing Sheets

PIVOT LATCH

BACKGROUND OF INVENTION a. Field of Invention

The invention relates generally to lever latches, and, more particularly to a lever latch for releasably latching a door to a corresponding door frame by providing a latch unit including a pivotally mounted trigger having a catch.

b. Description of Related Art

A need exists for an improved lever latch device that may be easily installed and operated, a device that includes fewer parts for ease of manufacturing, and a device that may be installed in a limited opening in a door (for example).

Trigger release lever devices are well known in the art and may be used for releasably latching doors, panels, windows and the like (as shown for example in FIG. 1). As shown in FIG. 2, an exemplary conventional trigger release lever latch, generally designated 1, includes a handle 2 in combination with a trigger 3. Handle 2 generally includes an extension 4 mounted thereto, which is adapted to engage a door frame 5 via adjustable bolt 6. Adjustable bolt 6 may be axially adjusted relative to extension 4 by rotating nuts 7 to loosen adjustable bolt 6 in order to adjust the height thereof, and subsequently rotating nuts 7 (in the opposite direction) to lock adjustable bolt 6 in place. Trigger 3, which is biased by a spring 8, is operably connected to handle 2 to release or prevent the release of handle 2 by means of nib 9 (on handle 2), which is insertable into notch 11 (on trigger 3). Conventional lever latch 1 further includes a rotatable lock cylinder 12 having L-shaped bracket 13 fixedly attached thereto. As shown in FIG. 3, L-shaped bracket 13 may be rotated between first and second orientations 14 and 15, respectively, to prevent or allow counter-clockwise pivoting of trigger 3 (relative to FIG. 2) about hinge 10. Specifically, as shown in FIGS. 2 and 3, L-shaped bracket 13 is in contact with contact member 16 in first orientation 14, and is rotated out of contact with contact member 16 in second orientation 15. Finally, conventional lever latch 1 also generally includes a slot 17 for insertion of a key (not shown) for rotation of lock cylinder 12.

In order to install the conventional lever latch 1 discussed above, generally, an opening having a width Al (see FIG. 3) is drilled or otherwise made in a door D (for example). Thereafter, conventional lever latch 1 is inserted into the opening and is held in place by top plate 18 having width A2 (see FIG. 4), which is greater than width A1 and a screw (not shown) for securing the housing to a door D (for example). It can be seen in FIG. 3 that in order to allow complete rotation of L-shaped bracket 13 from first orientation 14 to second orientation 15, the width of the opening must be at least A3 for door thickness>t (see FIG. 2). Thus, adequate installation of conventional lever latch 1, which requires an enlarged opening of width A3 or the like to allow free rotation of L-shaped bracket 13, can be quite complex and costly for the installer. Moreover, from a manufacturing standpoint, the manufacture and installation of L-shaped bracket 13 onto lock cylinder 12 can significantly increase the manufacturing cost of conventional lever latch 1, which may be manufactured by the thousands.

In the art, there currently exist various other conventional lever latches, as disclosed for example in U.S. Pat. Nos. 5,664,813, 5,638,709, 5,609,373 and 5,267,762. The lever latches disclosed in these Patents include basic components such as a trigger for operating a handle and a bolt to releasably latch a door to a corresponding door frame.

These conventional lever latches however have several disadvantages. Some of the key drawbacks generally include an excessive number of components, which can make the devices difficult and expensive to manufacture. Additionally, because of the excessive number of components, the odds of an essential component failing during normal usage is significantly increased, thus rendering the devices unreliable. Moreover, for the average consumer, conventional lever latch devices can be difficult to operate as they may require sophisticated installation and operation procedures.

SUMMARY OF INVENTION

The invention solves the problems and overcomes the drawbacks and disadvantages of the prior art by providing a lever latch, for releasably latching a door to a corresponding door frame, which is easier and relatively inexpensive to manufacture, and which is relatively simple to install and operate.

Thus an aspect of the invention is to avoid the need to cut an enlarged opening A3 (as discussed above), irrespective of the door thickness.

The invention accomplishes this by providing a lever latch that includes a housing mounted in an opening in the door and a handle pivotally mounted to the housing. The handle is rotatable between opened and closed positions, and is biased to the opened position by a torsion spring mounted to the housing and also includes a tongue, which is operable to maintain the handle in the closed position. The housing further includes a bolt pivotally mounted thereto. The bolt is adapted to engage the door frame when the handle is in the closed position and disengage the door frame when the handle is in the opened position. The bolt also includes an adjustment bolt mounted at an end thereof for permitting adjustable engagement of the bolt to the door frame. The housing yet further includes a trigger, pivotally mounted to the housing, and having a catch mounted thereon. The trigger is pivotable between first and second positions, and is operable to retain the handle when in the first position and release the handle when in the second position. The trigger is biased to the first position by a coil spring mounted to the housing. The housing also includes a pawl, having a cutout, rotatably mounted to the housing, and rotatable between unlocked and locked positions. In the unlocked position, the cutout is aligned with the catch to allow the trigger to pivot to the second position, and in the locked position, the cutout is out of alignment with the catch and the catch contacts a surface on the pawl to thereby prevent the trigger from being pivoted to the second position. Finally, the housing may also include a lock cylinder rotatably mounted therein, and fixedly attached to the pawl to rotate therewith.

In the above described lever latch, the latch components such as the housing, the handle, the bolt, the trigger and the pawl are made of aluminum, steel, or an equivalent metal, or of plastic, ceramic, or an equivalent material. The bolt and the handle may be manufactured as a one piece unit, or may be separately manufactured and thereafter joined together.

In yet another aspect of the invention, the invention avoids the need to cut an enlarged opening A3 (as discussed above), irrespective of the door thickness, by providing a lever latch including a housing and a latch mechanism including a handle and a bolt. The latch mechanism is operable to latch or un-latch the lever latch. The lever latch further includes a trigger mechanism, mounted to the housing, for operating the latch mechanism. The trigger mechanism includes a protrusion mounted thereon. The lever latch yet further includes a pawl, having a guide, mounted to the housing, and configurable between locked and unlocked positions. In the unlocked position, the guide is aligned with the protrusion to allow the trigger to operate the latch mechanism, and in the locked position, the guide is out of alignment with the protrusion and the protrusion contacts a surface on the pawl to thereby prevent the trigger from operating the latch mechanism.

Additional features, advantages, and embodiments of the invention may be set forth or apparent from consideration of the following detailed description, drawings, and claims. Moreover, it is to be understood that both the foregoing summary of the invention and the following detailed description are exemplary and intended to provide further explanation without limiting the scope of the invention as claimed.

BRIEF DESCRIPTION OF THE DRAWINGS

The accompanying drawings, which are included to provide a further understanding of the invention and are incorporated in and constitute a part of this specification, illustrate preferred embodiments of the invention and together with the detail description serve to explain the principles of the invention. In the drawings.

DETAILED DESCRIPTION OF THE PREFERRED EMBODIMENT

Figure 1:
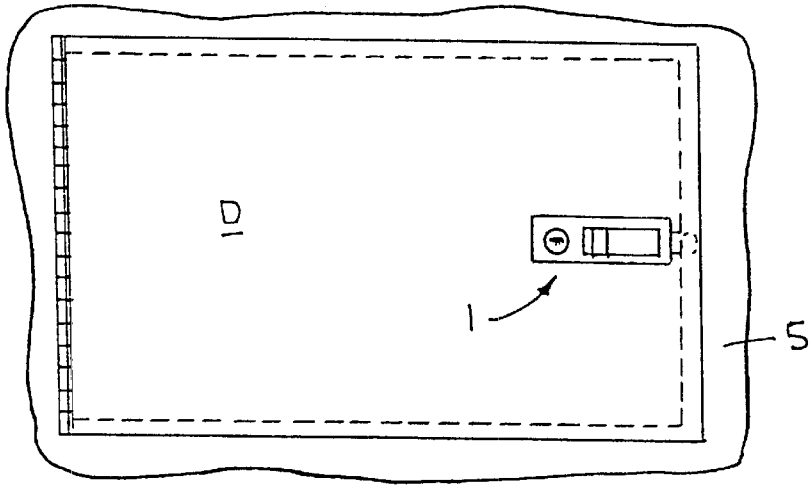
FIG. 1 (RELATED ART)
FIG. 1 is an exemplary diagram of a lever latch mounted to a door shown in a door frame.
Figure 2:
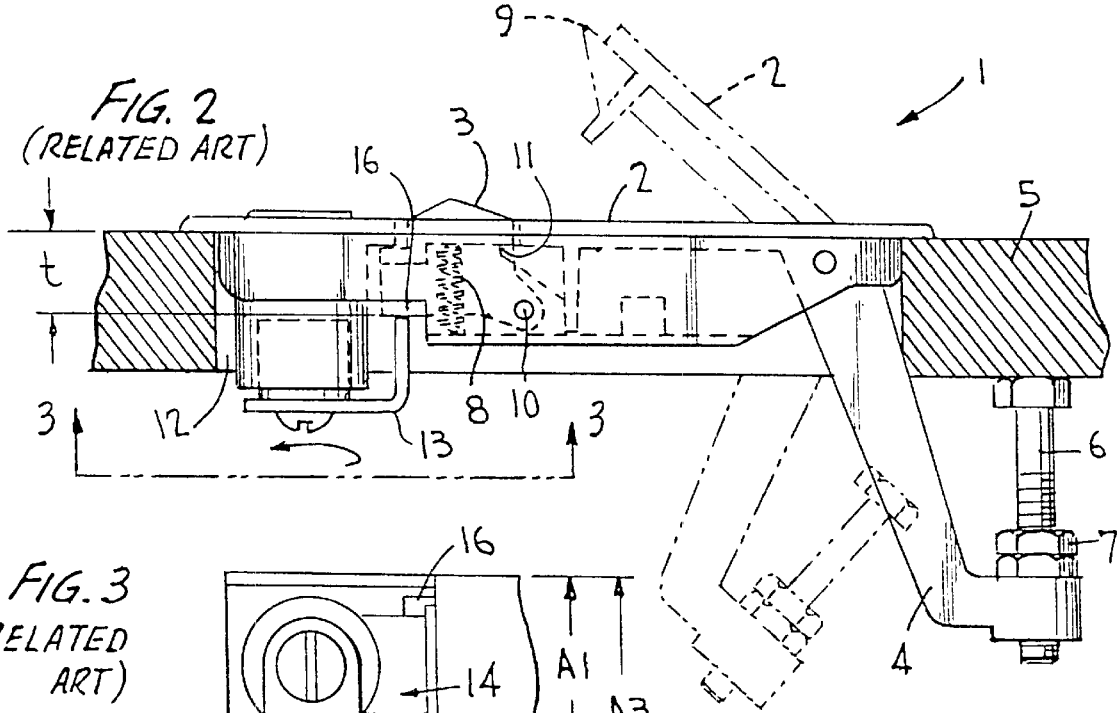
FIG. 2 (RELATED ART)
FIG. 2 is a sectional view of an exemplary related art lever latch, illustrating a handle in a closed (solid outline) and an opened position (phantom outline)
Figure 3:
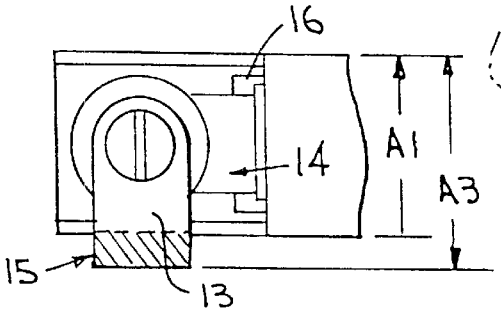
FIG. 3 (RELATED ART)
FIG. 3 is a partial bottom view of the exemplary related art lever latch of FIG. 2, taken along line 3—3 in FIG. 2.
Figure 4:
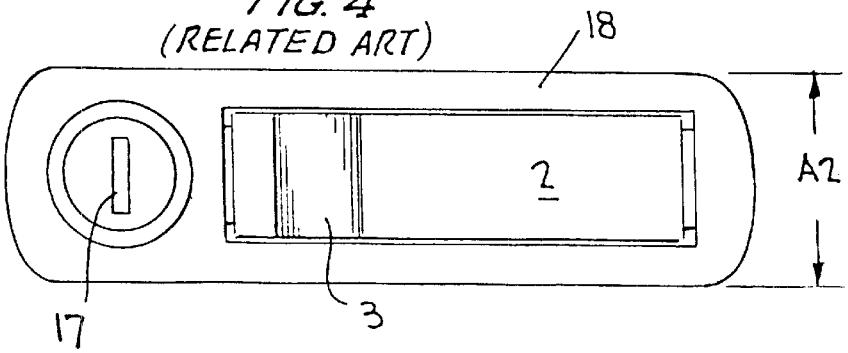
FIG. 4 (RELATED ART)
FIG. 4 is a top view of the exemplary related art lever latch of FIG. 2, illustrating its handle in the closed position.
Figure 5:
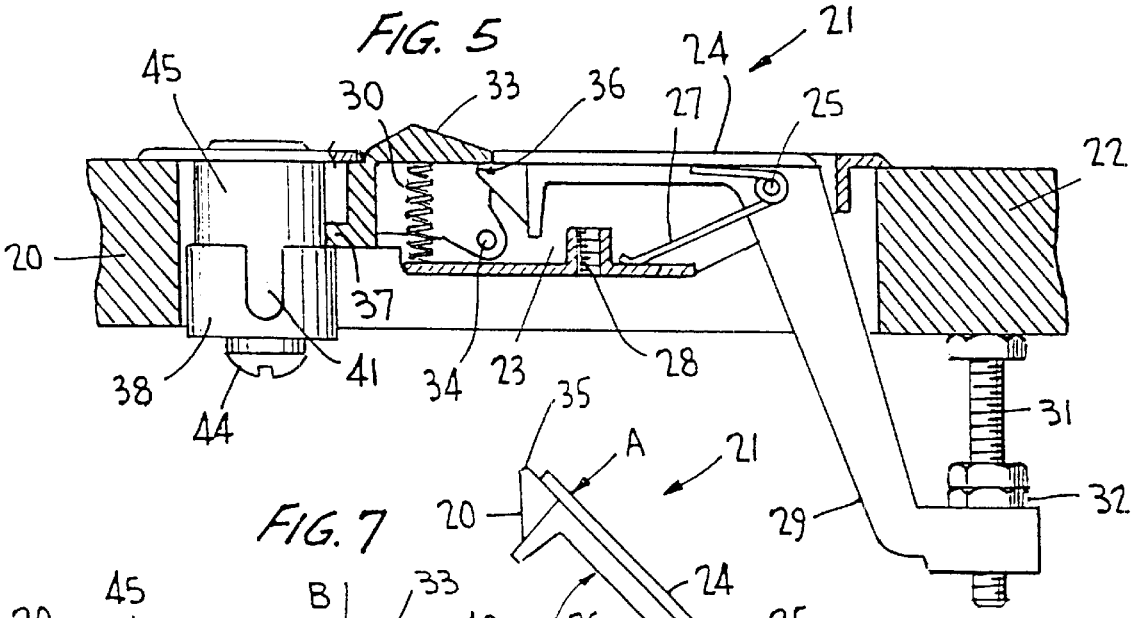
FIG. 5 is a sectional view of a lever latch according to the present invention, illustrating a handle in a closed position.

As shown in FIG. 5, a lever latch according to the present invention, generally designated 21, for releasably latching a door 20 (for example) to a corresponding door frame 22 may include a housing 23. Housing 23 may be mounted in an opening in door 20, as discussed below.

The components of lever latch 21, which may be mounted in housing 23, will now be described in detail.

Figure 7:
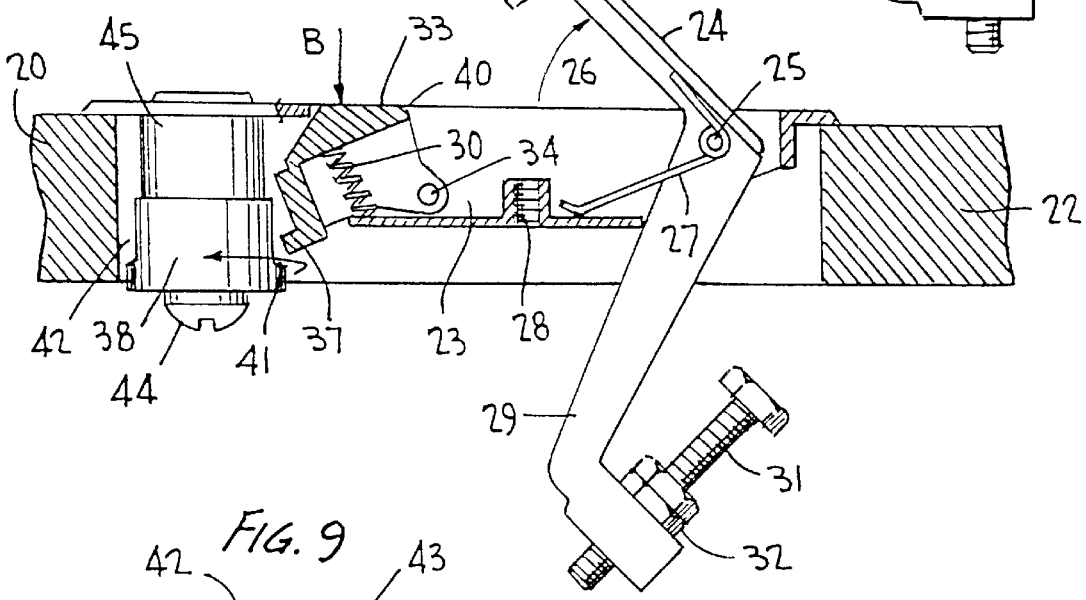
FIG. 7 is a sectional view of the lever latch of FIG. 5, illustrating the handle in an opened position.
Figure 9:
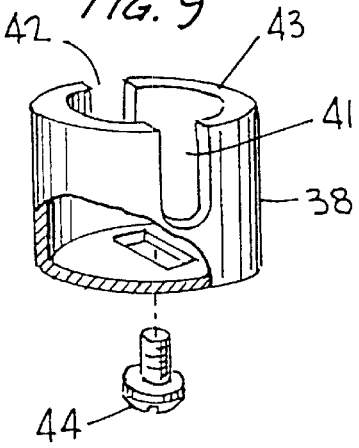
FIG. 9 is a perspective view of a pawl for the lever latch of FIG. 5.
Figure 6:
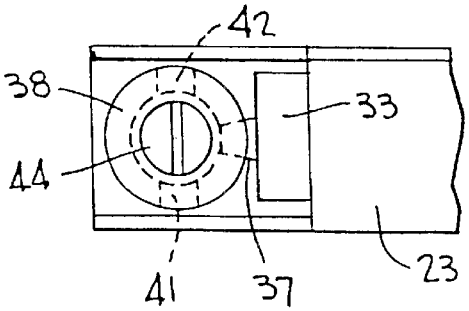
FIG. 6 is a partial bottom view of the lever latch of FIG. 5, illustrating the pawl in a locked position.
Figure 8:
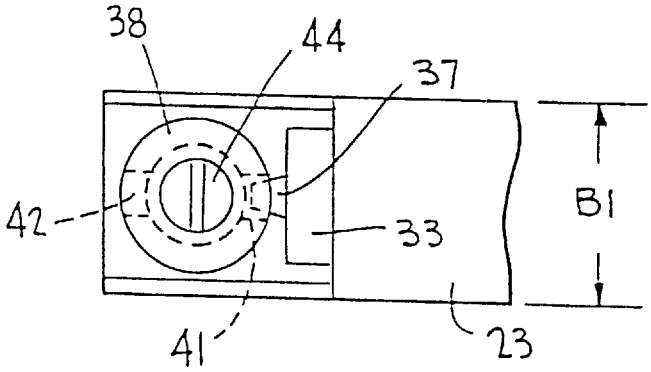
FIG. 8 is a partial bottom view of the lever latch of FIG. 5, illustrating the pawl in an unlocked position.

Referring to FIGS. 5 and 7, housing 23 may include a handle 24 pivotally mounted at hinge 25 and biased to an opened position 26 (shown in FIG. 7) by spring 27. Spring 27 may be a torsion spring, as shown in FIG. 7, or may be a conventional coil spring. Housing 23 may also include a threaded hole 28 for mounting lever latch 21 to door 20. Handle 24 is rotatable between the opened position 26 (discussed above) and may be rotated to a closed position (shown in FIG. 5) by a counter-clockwise force in the direction of arrow A, as shown in FIG. 7.

Lever latch 21 may further include a bolt 29 formed with handle 24 and pivotally mounted to hinge 25. Bolt 29 may be adapted to engage door frame 22 by adjustment bolt 31, as shown in FIG. 5. Specifically, the axial length of adjustment bolt 31, relative to bolt 29, may be adjusted to accommodate door frames of various thickness. This may be accomplished by loosening nuts 32, and thereafter adjusting the exposed length of adjustment bolt 31. Nuts 32 may then be tightened to lock the axial position of adjustment bolt 31 relative to bolt 29. Therefore, when handle 24 is in the closed position shown in FIG. 5, adjustment bolt 31 contacts door frame 22 to prevent door 20 from being opened. Likewise, when handle 24 is in the opened position 26 shown in FIG. 7, adjustment bolt 31 pivots away from door frame 22 and allows door 20 to be opened.

Lever latch 21 may next include a trigger 33 pivotally mounted to housing 23 at hinge 34. Trigger 33 may be pivotable between a first position shown in FIG. 5 and a second position shown in FIG. 7. Trigger 33 is operable to retain handle 24 in the first position by means of a tongue 35 on handle 24, which may be inserted into notched section 36.in trigger 33. Trigger 33 is further operable to release handle 24 to opened position 26 upon depression thereof to the second position by an application of a force in the direction of arrow B, shown in FIG. 7. Trigger 33 may also include a catch 37 and may be biased in the first position shown in FIG. 5 by a coil spring 30. Spring 30 may be a conventional coil spring, as shown in FIGS. 5 and 7, or may be a torsion spring.

Referring to FIGS. 5–9, lever latch 21 may further include a pawl 38 rotatably mounted in housing 23. Pawl 38 may include two opposed cutouts 41 and 42 for allowing insertion of catch 37. Pawl 38 may further include a top edge 43 and may be mounted in housing 23 to a lock cylinder 45 (described below) by means of screw 44. As shown in FIGS. 5 and 7, pawl 38 may be rotatable between an unlocked position shown in FIG. 7 and a locked position shown in FIG. 5. Referring to FIG. 7, in the unlocked position, cutout 41 may be aligned with catch 37 to allow trigger 33 to pivot downwards (to the second position) under the application of a force in the direction of arrow B. Likewise, referring to FIG. 5, in the locked position, cutout 41 may be rotated out of alignment with catch 37 to prevent trigger 33 from being pivoted to the second position. Specifically, it can be seen in FIG. 5 that in the locked position of pawl 38, top edge 43 of pawl 38, which contacts catch 37 of trigger 33, prevents the downward depression of trigger 33 by a force in the direction of arrow B.

Figure 10:
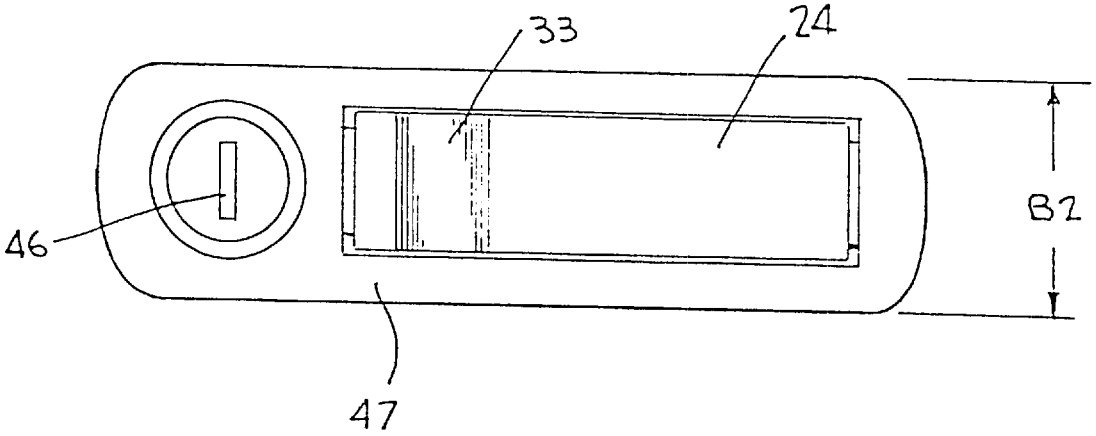
FIG. 10 is a top view of the lever latch according to the present invention.

Referring now to FIGS. 5 and 7, lever latch 21 may further include rotatably mounted lock cylinder 45 (discussed above) onto which pawl 38 may be fixedly mounted for rotation therewith. As shown in FIG. 10, lock cylinder 45 may include a slot 46 for insertion of a key (not shown) for rotation of lock cylinder 45, and for "locking" and "unlocking" of lever latch 21.

Next, the installation and operation of lever latch 21 will be described in detail.

In order to install lever latch 21, an opening having a width B1 (shown in FIG. 8) of the body of housing 23, which is slightly smaller than the dimension B2 (shown in FIG. 10) may be drilled or otherwise made in door 20 (for example). Thereafter, lever latch 21 may be inserted into the opening and is held in place by top plate 47, having width B2. As discussed above, adjustment bolt 31 may next be adjusted to accommodate for the width of door frame 22. Finally, a screw (not shown), inserted into threaded hole 28, may be used to fixedly attach lever latch 21 to door 20 (for example).

In order to operate lever latch 21, lock cylinder 45 may be rotated by a key inserted into slot 46 to thereby rotate pawl 38 between the unlocked position shown in FIG. 7 and the locked position shown in FIG. 5. As discussed above, as shown in FIG. 7, in the unlocked position, cutout 41 may be aligned with catch 37 to allow trigger 33 to pivot downwards (to the second position) under the application of a force in the direction of arrow B. Likewise, as shown in FIG. 5, pawl 38 may be rotated to the locked position, such that cutout 41 may be out of alignment with catch 37, to prevent a downward depression of trigger 33. Therefore, in order to open lever latch 21, or in other words, in order to rotate handle 24 to opened position 26 shown in FIG. 7, lock cylinder 45 may first be rotated to the unlocked position shown in FIG. 7. Thereafter, trigger 33 may be depressed by a force in the direction of arrow B to release handle 24 under the bias of spring 27. Likewise, in order to close lever latch 21, handle 24 may be depressed by a force in direction of arrow A (see FIG. 7), to pivot handle 24 to the closed position shown in FIG. 5. Thus, when a force is applied in the direction of arrow A, edge 20 on tongue 35 slides against edge 40 on trigger 33 to pivot trigger 33 as shown in FIG. 7. When edge 20 has slid its complete length against edge 40, the top flat portion of tongue 35 is inserted into notched section 36 to hold handle 24 in the closed position of FIG. 5. It should be evident from the above discussion, that in order to completely close handle 24, lock cylinder 45 and pawl 38 must be in their unlocked position shown in FIG. 7, so as to allow catch 37 to freely slide in cutout 41. After handle 24 is placed in the closed position of FIG. 5, lock cylinder 45 may be rotated by a key inserted into slot 46 to thereby rotate pawl 38 to the locked position shown in FIG. 5, to prevent further depression of trigger 33.

In the lever latch 21 discussed above, each component discussed above may be made of aluminum, steel, or an equivalent metal, or of plastic, ceramic, or an equivalent material. Additionally, it should be evident from the above discussion that bolt 29 and handle 24 may be manufactured from a single piece of material, or may likewise be manufactured separately and joined to each other to allow for simultaneous pivoting about hinge 25, as would be apparent to a skilled artisan. Pawl 38 may also include a single cutout, instead of opposed cutouts 41 and 42. Opposed cutouts 41 and 42 provide for a symmetrical pawl unit and thus facilitate assembly of pawl 38 onto lock cylinder 45 during the manufacturing process of lever latch 21.

Although particular embodiments of the invention have been described in detail herein with reference to the accompanying drawings, it is to be understood that the invention is not limited to those particular embodiments, and that various changes and modifications may be effected therein by one skilled in the art without departing from the scope or spirit of the invention as defined in the appended claims.

What is claimed is:

1. A lever latch for releasably latching a door to a corresponding door frame, said lever latch comprising:

a housing mounted in an opening in the door;

a handle pivotally mounted to said housing and rotatable between opened and closed positions;

a bolt pivotally mounted to said housing and engageable to the door frame when said handle is in said closed position and disengageable from the door frame when said handle is in said opened position, said bolt being automatically pivotable in a first predetermined direction toward said opened position;

a trigger pivotally mounted to said housing for movement between first and second positions, said trigger being operable to retain said handle when in said first position and being operable to release said handle when in said second position, said trigger being pivotable in a direction opposite said first predetermined direction to release said handle; and a pawl rotatably mounted to said housing for movement between locked and unlocked positions, wherein, in said unlocked position, at least one cutout on said pawl being aligned with a catch on said trigger to allow said trigger to pivot to said second position, and in said locked position, said at least one cutout being out of alignment with said catch and said catch contacting a surface on said pawl to thereby prevent said trigger from being pivoted to said second position.

2. The lever latch according to claim 1, wherein said housing, said handle, said bolt, said trigger and said pawl are made of a plastic, a ceramic or a metal.

3. The lever latch according to claim 1, wherein said handle is biased to said opened position by a spring mounted to said housing.

4. The lever latch according to claim 3, wherein said spring is one of a torsion spring or a coil spring.

5. The lever latch according to claim 1, wherein said handle further comprises a tongue, said tongue being operable to maintain said handle in said closed position.

6. The lever latch according to claim 1, wherein said bolt further comprises an adjustment bolt mounted at an end thereof for permitting adjustable engagement of said bolt to the door frame.

7. The lever latch according to claim 1, wherein said bolt is fixedly attached to said handle to thereby pivot with said handle.

8. The lever latch according to claim 1, wherein said trigger is biased to said first position by a spring mounted to said housing.

9. The lever latch according to claim 8, wherein said spring is one of a torsion spring or a coil spring.

10. The lever latch according to claim 1, wherein said at least one cutout includes two cutouts.

11. The lever latch according to claim 1, said lever latch further comprises a lock cylinder rotatably mounted to said housing, said pawl being fixedly attached to said lock cylinder to rotate with said lock cylinder.

12. A lever latch comprising:

a housing;

a latch mechanism, including a handle and a bolt, mounted to said housing and operable between closed and opened positions, said bolt being automatically pivotable in a first predetermined direction toward said opened position;

a trigger, mounted to said housing, for operating said latch mechanism, said trigger being pivotable in a direction opposite said first predetermined direction to operate said latch mechanism; and a pawl mounted to said housing and configurable between locked and unlocked positions, wherein, in said unlocked position, at least one guide on said pawl being aligned with a protrusion on said trigger to allow said trigger to operate said latch mechanism, and in said locked position, said at least one guide being out of alignment with said protrusion and said protrusion contacting a surface on said pawl to thereby prevent said trigger from operating said latch mechanism.

13. The lever latch according to claim 12, wherein said housing, said handle, said bolt, said trigger and said pawl are made of a plastic, a ceramic or a metal.

14. The lever latch according to claim 12, wherein said latch mechanism is biased to said opened position by a spring mounted to said housing.

15. The lever latch according to claim 14, wherein said spring is one of a torsion spring or a coil spring.

16. The lever latch according to claim 12, wherein said handle further comprises a tongue, said tongue being operable to maintain said latch mechanism in said closed position.

17. The lever latch according to claim 12, wherein said bolt further comprises an adjustment bolt mounted at an end thereof for permitting adjustable engagement of said bolt to a door frame.

18. The lever latch according to claim 12, wherein said bolt is fixedly attached to said handle to thereby pivot with said handle.

19. The lever latch according to claim 12, wherein said trigger is biased to a first position, to retain said latch mechanism in said closed position, by a spring mounted to said housing.

20. The lever latch according to claim 19, wherein said spring is one of a torsion spring or a coil spring.

21. The lever latch according to claim 12, wherein said at least one guide includes two cutouts.

22. The lever latch according to claim 12, said lever latch further comprises a lock cylinder rotatably mounted to said housing, said pawl being fixedly attached to said lock cylinder to rotate with said lock cylinder.

* * * * *